US010561558B2

(12) United States Patent
Kaikenger

(10) Patent No.: US 10,561,558 B2
(45) Date of Patent: Feb. 18, 2020

(54) PATIENT LIFT SYSTEM WITH COMPONENT COMPATIBILITY FEATURES

(71) Applicant: Liko Research & Development AB, Luleå (SE)

(72) Inventor: Philippe Kaikenger, Pluvigner (FR)

(73) Assignee: Liko Research & Development AB, Lulea (SE)

( * ) Notice: Subject to any disclaimer, the term of this patent is extended or adjusted under 35 U.S.C. 154(b) by 668 days.

(21) Appl. No.: 15/213,929

(22) Filed: Jul. 19, 2016

(65) Prior Publication Data

US 2017/0027796 A1 Feb. 2, 2017

Related U.S. Application Data

(60) Provisional application No. 62/199,404, filed on Jul. 31, 2015.

(51) Int. Cl.
*A61G 7/10* (2006.01)

(52) U.S. Cl.
CPC ..... *A61G 7/1063* (2013.01); *A61G 7/1015* (2013.01); *A61G 7/1042* (2013.01);
(Continued)

(58) Field of Classification Search
CPC .. A61G 7/1063; A61G 7/1015; A61G 7/1042; A61G 7/1051; A61G 7/1078;
(Continued)

(56) References Cited

U.S. PATENT DOCUMENTS 3,645,406 A * 2/1972 Brazell ..... B66C 1/223 212/344
3,841,495 A * 10/1974 Dronick ..... B66C 17/04 212/330

(Continued)

FOREIGN PATENT DOCUMENTS

EP 1031339 A2 8/2000
EP 2777675 A1 9/2014

(Continued)

OTHER PUBLICATIONS

Extended European Search Report dated Dec. 22, 2016 for EP Patent Application No. 16181915.6.

*Primary Examiner* — Nicholas F Polito
*Assistant Examiner* — Myles A Throop
(74) *Attorney, Agent, or Firm* — Dinsmore & Shohl LLP

(57) ABSTRACT

Patient lift systems and lift accessories for the same are disclosed. In one example, a system may include a rail having a carriage support channel formed in the rail, the channel having a width, the rail has a working load rating; a carriage slidably disposed in the rail for relative movement to the rail, the carriage comprising a shaft having a length; and a lift unit coupled to the carriage and operable to raise and lower a lifting strap, wherein the lift unit has a working load rating; wherein the length of the shaft of the carriage is less than the width of the channel when the working load rating of the lift unit is equal to or less than the working load rating of the rail. In this manner, lift units that are incompatible with the working load rating of the rail cannot be connected with the rail.

9 Claims, 7 Drawing Sheets

(52) U.S. Cl.
CPC ..... *A61G 7/1051* (2013.01); *A61G 2203/70* (2013.01); *A61G 2205/20* (2013.01); *A61G 2205/40* (2013.01)

(58) Field of Classification Search
CPC ..... A61G 7/1061; A61G 2203/70; A61G 2205/40; A61G 2205/30; A61G 2205/50; A61G 2205/20
See application file for complete search history.

(56) References Cited

U.S. PATENT DOCUMENTS

| | | | | |
|---|---|---|---|---|
| 5,809,591 | A * | 9/1998 | Capaldi | A61G 7/1015 5/83.1 |
| 9,084,709 | B2 * | 7/2015 | Karlsson | B66C 1/12 |
| 9,222,498 | B2 * | 12/2015 | Faucher | F16B 19/00 |
| 2014/0013503 | A1 * | 1/2014 | Dixon | A61G 7/1073 5/85.1 |
| 2015/0136313 | A1 | 5/2015 | Bergenstråle et al. | |
| 2015/0166084 | A1 * | 6/2015 | Brannstrom | B66C 7/14 104/102 |
| 2017/0137264 | A1 * | 5/2017 | Bogh-Sorensen | B66C 7/14 |

FOREIGN PATENT DOCUMENTS

| | | | |
|---|---|---|---|
| EP | 2862552 | A1 | 4/2015 |
| WO | 2008029272 | A2 | 3/2008 |
| WO | 2013034936 | A1 | 3/2013 |

* cited by examiner

PATIENT LIFT SYSTEM WITH COMPONENT COMPATIBILITY FEATURES

CROSS REFERENCE TO RELATED APPLICATIONS

The present specification claims priority to U.S. Provisional Patent Application Ser. No. 62/199,404 filed Jul. 31, 2015 and entitled "Patient Lift System With Component Compatibility Features," the entirety of which is incorporated by reference herein.

TECHNICAL FIELD

The present specification generally relates to patient lift systems and, more specifically, to patient lift systems with compatibility indicators or structures on components thereof.

BACKGROUND

Overhead lifting systems, such as patient lift devices used in the health care industry, may generally comprise an overhead rail that guides a lift unit with an actuator, such as an electric motor or similar actuator, coupled to a mechanical lifting arm or cable lift system, such as a lifting strap. The lifting strap may be connected with a sling bar, to which a sling or other lifting accessory is connected. During use, a patient is positioned within the lifting accessory, and the lifting accessory is connected with the sling bar. The actuator of the lift unit controls raising and/or lowering of the patient that has been positioned within the lifting accessory.

Several components in a patient lift system are rated based upon a maximum working load (WL) that each component or sub-assembly can support. The working load rating is typically expressed in a weight value such as kilograms or pounds. By way of example only, a rail may be rated with a working load of "Extra Large" for a maximum load of 250 kg; a carrier or lift unit may be rated with a working load of "Large" for a maximum load of 150 kg; and a lifting accessory such as sling may be rated with a working load of "Medium" for a maximum load of 100 kg. Often, various components of a patient lift system may be interchanged—for instance, a variety of different sized slings exist, each having different working load ratings.

Accordingly, a need exists for encouraging operators of patient lift systems (such as nurses or other healthcare personnel) to use components with compatible working loads ratings, so as to properly use a patient lift system.

SUMMARY

According to one broad aspect of one embodiment of the present disclosure, disclosed herein is a rail-mounted patient lift system. In one example, the system may include a rail having a carriage support channel formed in the rail, the channel having a width, the rail has a working load rating; a carriage slidably disposed in the rail for relative movement to the rail, the carriage comprising a shaft having a length; and a lift unit coupled to the carriage, the lift unit operable to raise and lower a lifting strap, wherein the lift unit has a working load rating; wherein the length of the shaft of the carriage is less than the width of the channel when the working load rating of the lift unit is equal to or less than the working load rating of the rail. In this manner, lift units that are incompatible with the working load rating of the rail cannot be connected with the rail.

In one example, the length of the shaft of the carriage is greater than the width of the channel when the working load rating of the lift unit is larger than the working load rating of the rail. In another example, the channel of the rail does not receive the shaft of the lift unit when the working load rating of the lift unit is larger than the working load rating of the rail.

In another example, the system may also include a sling bar attached with the lifting strap; and a lifting accessory (such as a lifting sling or other lifting accessory) coupled with the sling bar. In one example, the lifting accessory may include an identifier indicating the working load rating of the lifting accessory. The lifting accessory may also include a unique indicator that corresponds with a working load rating of the lifting accessory. The indicator may be, for example, a color, an alpha-numeric indicator, a symbol or combinations thereof.

In another example, the sling bar may include an opening that is sized to receive one or more attachment handles of a lifting accessory if the working load rating of the lift unit is larger than the working load rating of the lifting accessory.

According to another embodiment of the present disclosure, disclosed herein is a patient lift system. In one example, the patient lift system may include a lift unit operable to raise and lower a lifting strap, wherein the lift unit has a working load rating; a sling bar attached with the lifting strap; and a lifting accessory (such as a lifting sling or other lifting accessory) coupled with the sling bar. The sling bar may include an opening that is sized to receive one or more attachment handles of the lifting accessory if the working load rating of the lift unit is larger than the working load rating of the lifting accessory.

In one example, the opening of the sling bar does not receive the one or more attachment handles of the lifting accessory if the working load rating of the lift unit is smaller than the working load rating of the lifting accessory. The lifting accessory may include an identifier indicating the working load rating of the lifting accessory. The lifting accessory may also include a unique indicator that corresponds with a working load rating of the lifting accessory. The indicator may be, for example, a color, an alpha-numeric indicator, a symbol or combinations thereof.

According to another embodiment of the present disclosure, disclosed herein is a lifting accessory for a patient lift system having a lift unit. In one example, the lifting accessory may include a main body made of a material; and a set of attachment handles; wherein the material includes a unique indicator based on the working load rating of the lifting accessory. The indicator may be, for example, a color, an alpha-numeric indicator, a symbol or combinations thereof. In one example, the lifting accessory may include a lifting sling, a lifting vest, a lifting strap, a lifting sheet, or the like.

In one example, the lifting accessory may include an identifier indicating the working load rating of the lifting accessory. The set of attachment handles may have a diameter adapted to fit within an opening of a sling bar when the working load rating of the lifting accessory is equal to or less than a working load rating of the lift unit.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

As described herein, various embodiments of patient lift systems are disclosed with features or structures that promote proper interconnections between components that have compatible working load (WL) ratings. In one example and as shown in FIGS. 5A to 5D, differing sizes of rails and carrier shafts are used to promote proper component compatibility in terms of working load ratings. In another example, in FIGS. 6A to 6D, unique indicators and working load rating information may be attached or associated with various lifting accessories (the term "lifting accessories" includes but is not limited to lifting slings, lifting vests, lifting straps, lifting sheets or the like, and combinations or subcombinations thereof); and in another example, in FIGS. 7A-7C, sizing of openings in the sling bars along with sizing of the attachment handles of a lifting accessory are used together to encourage working load rating compatibility. In this manner, embodiments of the present disclosure aid operators of patient lift systems in proper use of such systems and their related components. Various embodiments of patient lift systems and lifting accessories for promoting proper component compatibility will be described herein with specific reference to the appended drawings.

Figure 1:
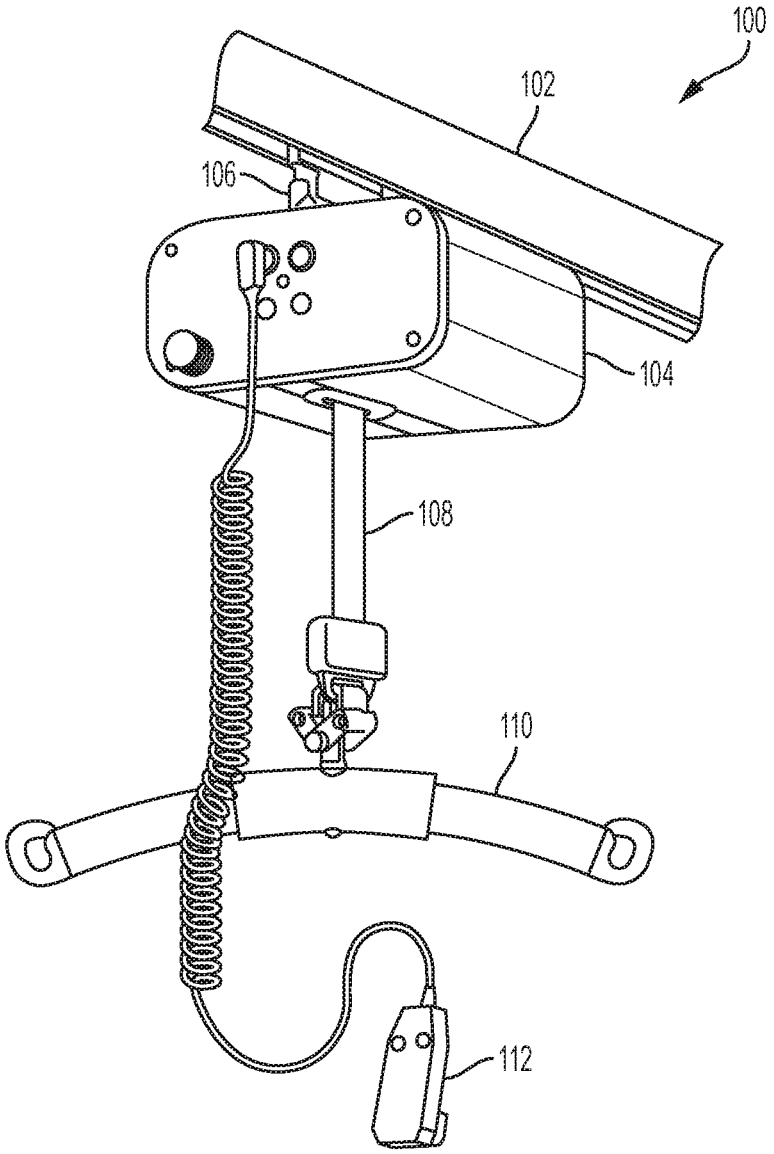
FIG. 1 schematically depicts a rail-mounted lift system, according to one or more embodiments described herein.

FIG. 1 generally depicts one embodiment of a rail-mounted patient lift system 100. The patient lift system 100 generally comprises a lift unit (also referred to as a carrier) 104 slidably coupled to a rail 102 with a carriage 106. The lift unit 104 may be used to support and/or lift a patient 107 (FIG. 4) with a lifting strap 108 which is coupled to a motor contained within the lift unit 104. The motor facilitates paying-out or taking-up the lifting strap 108 from the lift unit 104, thereby raising and lowering a patient 107 attached to the lift strap.

Figure 3:
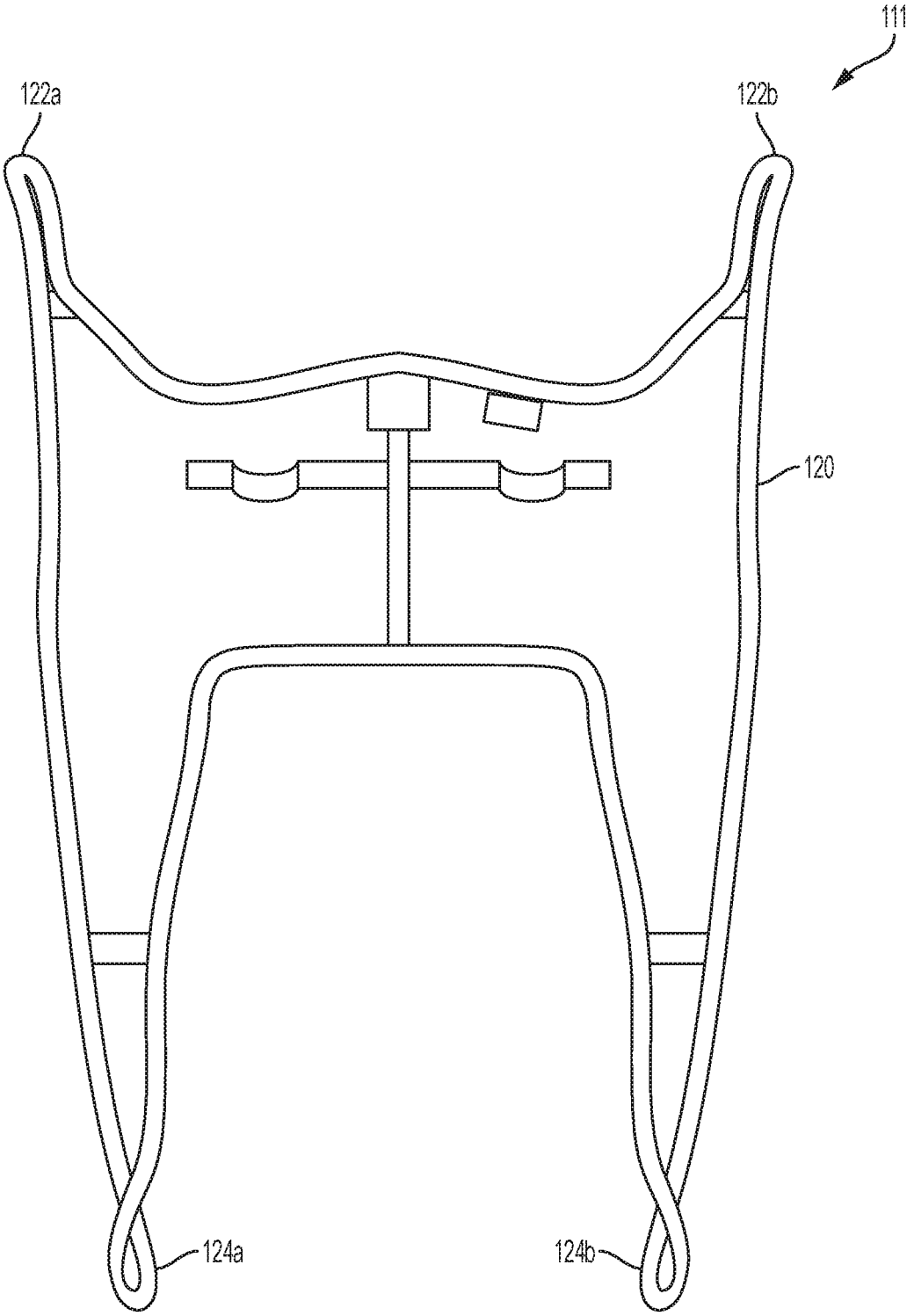
FIG. 3 schematically depicts an example of a lifting accessory in the form of a lifting sling for supporting a patient therein, the lifting accessory being attachable to the lift system of FIG. 1, according to one or more embodiments described herein.
Figure 4:
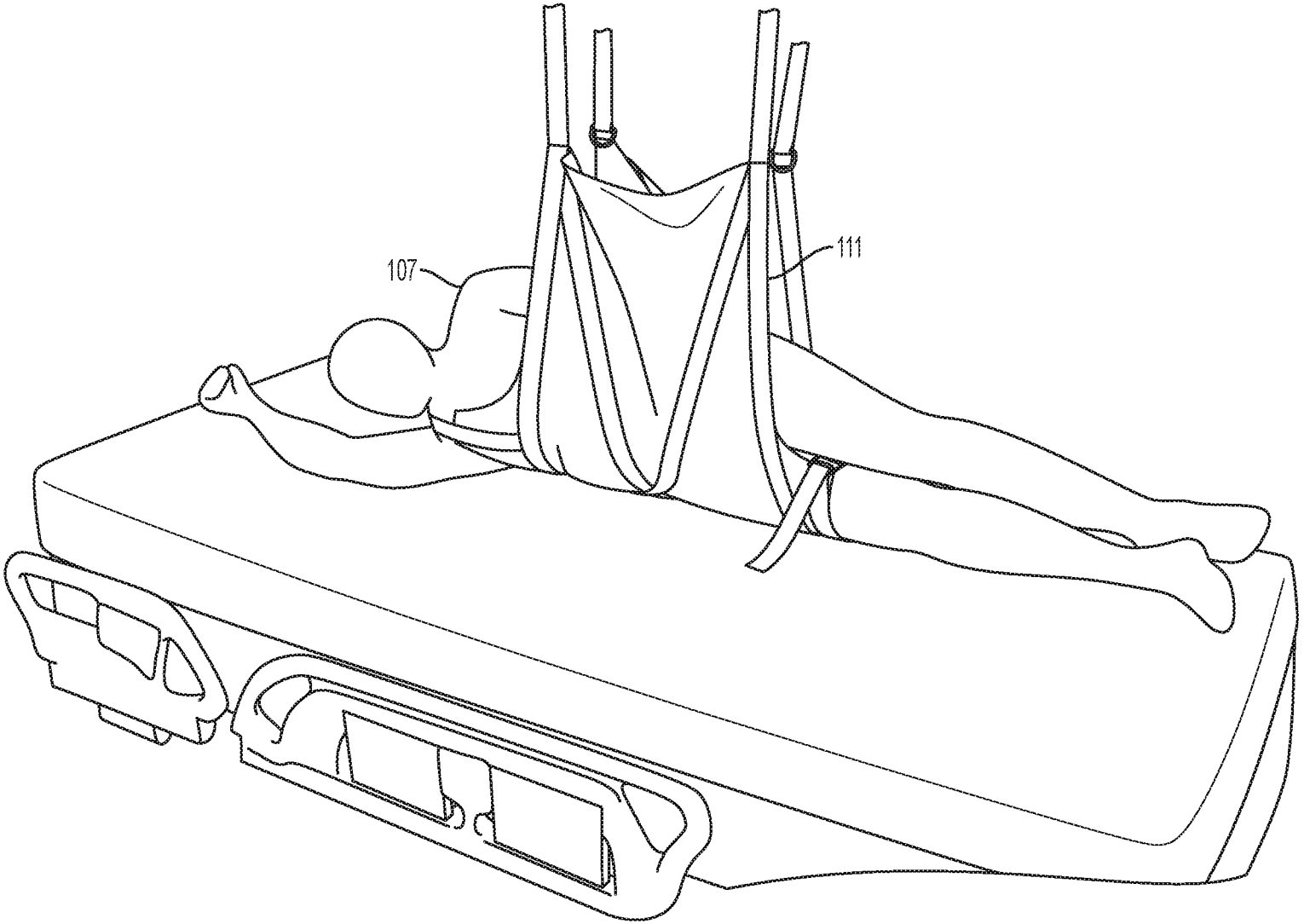
FIG. 4 schematically depicts a patient being repositioned by another example of a lifting accessory in the form of a lifting sheet, according to one or more embodiments described herein.

In the embodiment of the lift system 100 shown in FIG. 1, a patient may be attached to the lifting strap 108 with a sling bar 110 or a similar accessory attached to the lifting strap 108. More specifically, the sling bar 110 or a similar accessory may be attached to a lift accessory 111 (such as a lifting sling, lifting harness, lifting vest, lifting strap, repositioning sheet or the like). For example, in some embodiments, the lift accessory 111 may be a lifting sling as shown in FIG. 3 or a repositioning sheet as shown in FIG. 4. The patient is positioned in the lift accessory 111 thereby facilitating the lifting operation. The lift unit 104 may be actuated with hand control 112 which is communicatively coupled to the motor. In the embodiment shown in FIG. 1, the hand control 112 is directly wired to the lift unit 104. However, it should be understood that, in other embodiments, the hand control 112 may be wirelessly coupled to the lift unit 104 to facilitate remote actuation of the lift unit 104.

Figure 2:
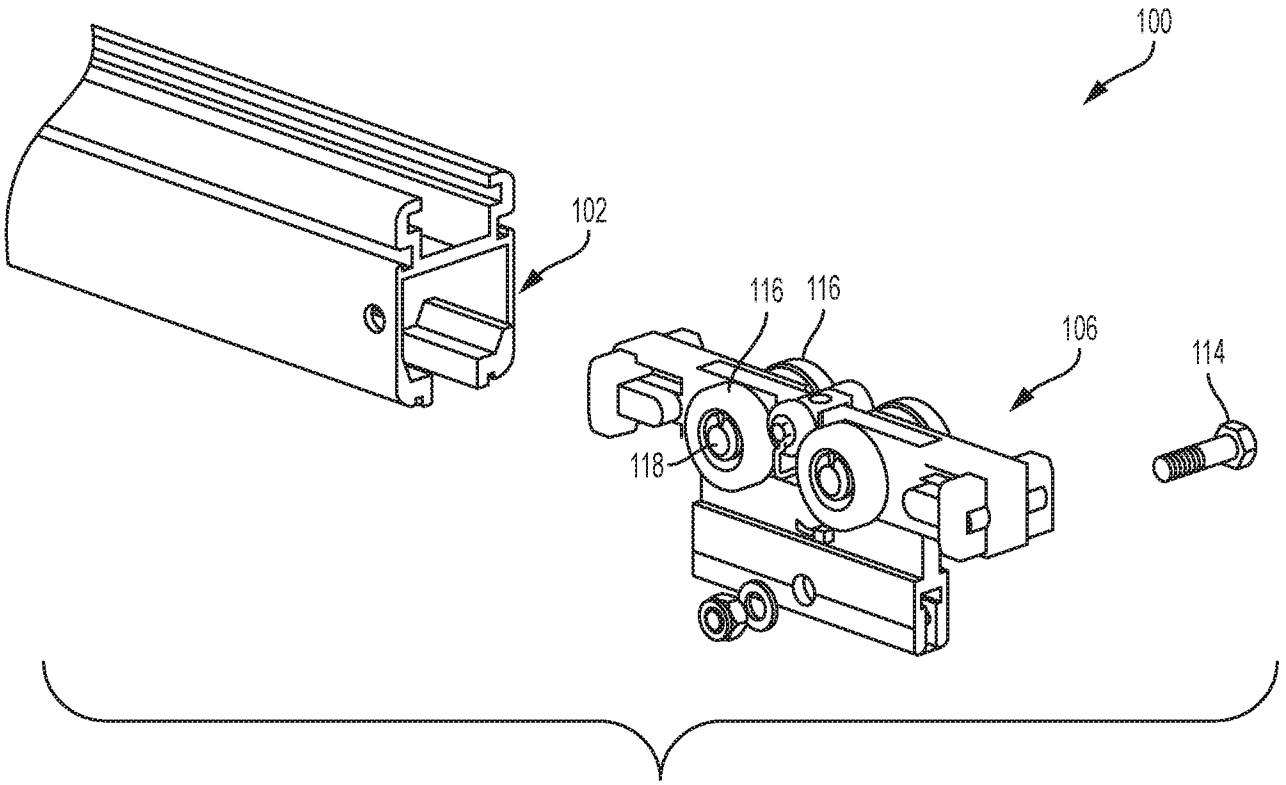
FIG. 2 schematically depicts an exploded view of the rail-mounted lift system of FIG. 1.

Referring now to the exploded view of the lift system 100 schematically depicted in FIG. 2, the lift unit 104 is mechanically coupled to a carriage 106 which facilitates slidably positioning the lift unit 104 along rail 102. In one example, the lift unit 104 may be connected with and secured to a lower portion of the carriage 106 with a fastener or set of fasteners 114, such as a bolt and nut as depicted in FIG. 2, which may extend transversely through openings in the carriage 106 and the lift unit 104.

The carriage 106 generally comprises a carriage body to which a plurality of support wheels/rollers 116 are rotatably attached for supporting the carriage 106 within the rail 102. In the embodiments described herein, the carriage 106 is depicted with four support wheels. However, it is contemplated that the carriage 106 may be constructed with fewer than or more than 4 support wheels. For example, in some embodiments, the carriage may be constructed with one or two support wheels (i.e., a pair of support wheels). Accordingly, it should be understood that the carriage 106 includes at least one support wheel 116. The support wheels 116 are positioned on axles or shafts 118 which extend transversely through the carriage 106. Each support wheel may be secured to the shaft 118 with a fastener, such as retaining clips, such that the support wheels are rotatable on the shaft 118.

The support wheels 116 may be passive (i.e., the support wheels are not actively driven with a motor or a similar drive mechanism) and the lift unit is manually traversed along the rail; or, in another embodiment (not shown), the support wheels 116 may be actively driven such as when the support wheels are coupled to a motor or a similar mechanism. In such embodiments, the drive mechanism may be communicatively coupled to a hand control (such as hand control 112 shown in FIG. 1) which actuates the drive mechanism and facilitates traversing the lift unit along the rail with the drive mechanism.

The rail 102, in which the carriage 106 is slidably disposed for relative movement, may be generally formed from a metallic material, such as aluminum, an aluminum alloy, or a similar metallic material. In one example, rail 102 (see FIG. 5A) may generally comprises an upper portion 130, a first sidewall 132*a* integrally formed with the upper portion 130, and a second sidewall 132*b* integrally formed with the upper portion 130. The upper portion 130, first sidewall 132*a* and second sidewall 132*b* are oriented such that the upper portion 130, first sidewall 132*a* and second sidewall 132*b* form a carriage support channel 135 in which the carriage 106 is slidably disposed. To that end, the first sidewall 132*a* may, in one example, include a support flange 136*a*, and the second sidewall 132*b* may further comprise a second support flange 136*b*. However, it should be understood that other configurations of the rail 102 are also contemplated.

FIGS. 3-4 depict examples of lift accessories 111 that may be used to support and move a patient 107 when the lift accessory 111 is coupled with the patient lift system 100. For instance, as shown in FIG. 4, lift accessory 111 (in this instance a repositioning sheet) with lift system 100 can be used to reposition a patient 107 on a hospital bed. The lift accessory 111 may be formed of various flexible and tear-resistant materials, such as synthetic materials, nylons, cloths, or other sturdy materials. In some embodiments, the lift accessory 111 may include a main portion 120, with upper and lower attachment handles 122*a,b* and 124*a,b*, as depicted in FIG. 3. The attachment handles may be reinforced and may include loops or openings so that the attachment handles can be securely connected with respective ends of the sling bar during use. Other features and structures related to the lift accessory 111 and the attachment handles 122, 124 of the lift accessory 111 are described herein.

In accordance with one example of the present disclosure, a rail 102 and the components of a lift unit/carrier 104 are sized so that only compatible components—with comparable or compatible working load (WL) ratings of each—can be connected together during use. Specifically, the cross-sections of rails 102 are varied based on their working load ratings, and the length of the shafts 118 of lift units/carriers 104 are varied based on their working load ratings, so that only certain lift units/carriers 104 can be connected with appropriate rails 102 in a manner that compatible working load ratings between these components are maintained.

Figure 5A:
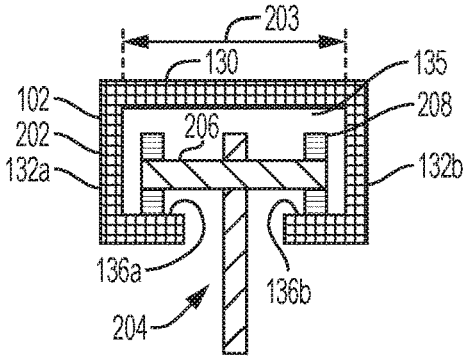
FIG. 5A illustrates one embodiment of a rail and a carriage positioned within the rail, according to one or more embodiments described herein.

For instance, as shown in FIG. 5A, a first rail 202 is associated with a first working load rating value (for example, "Medium"). The first rail 202 has an internal cavity width dimension 203. A first carrier body 204 has a carrier shaft 206 with rollers 208 attached to the carrier shaft 206, with the carrier body 204 attached with the carrier shaft 206. The first carrier body 204 has a working load rating value associated with it (for example, "Medium"), as well as a shaft length. The length of the carrier shaft 206 of the first carrier is sized so that it fits within the internal cavity width dimension 203 of the first rail 202, thereby permitting an operator (such as a nurse or other medical personnel) to connect the first carrier body 204 with the first rail 202 since they have compatible working load ratings.

Figure 5B:
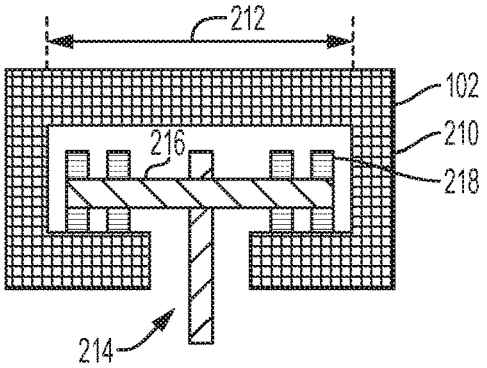
FIG. 5B illustrates another embodiment of a rail and a carriage positioned within the rail, according to one or more embodiments described herein.

As shown in FIG. 5B, a second rail 210 is associated with a second working load rating value (for example, "Large"). The second rail 210 has an internal cavity width dimension 212, which is larger than the internal cavity width dimension 203 of the first rail 202 of FIG. 5A. A second carrier body 214 has a carrier shaft 216 with rollers 218 attached to the carrier shaft 216, and a carrier body 214 attached with the carrier shaft 216. The second carrier body 214 has a working load rating value associated with it (for example, "Large"), and a shaft length. The length of carrier shaft 216 of the second carrier body 214 is sized so that it fits within the internal cavity width dimension 212 of the second rail 210. However, in accordance with one embodiment of the present disclosure, the shaft length of the second carrier body 214 is sized so that it will not physically fit within the internal cavity 203 of the first rail 202. By virtue of the size of the second carrier shaft 216 being larger than the internal cavity 203 of the first rail 202, an operator could not inadvertently attach a carrier body 214 having a larger working load rating value (such as "Large", i.e., 150 kg maximum) to a rail 202 having a lower working load rating value (such as "Medium", i.e., 100 kg maximum). This thereby prevents an inadvertent mis-match of components of the lift system 100 by an operator.

Figure 5C:
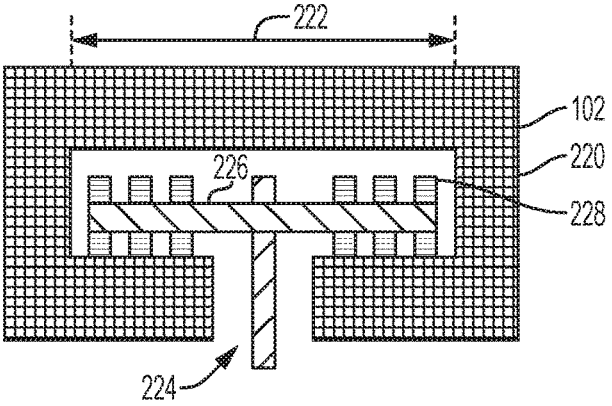
FIG. 5C illustrates another embodiment of a rail and a carriage positioned within the rail, according to one or more embodiments described herein.

As shown in FIG. 5C, a third rail 220 is associated with a third working load rating value (for example, "Extra Large"). The third rail 220 has an internal cavity width dimension 222, which is larger than the internal cavity width dimension 203 of the first rail 202 of FIG. 5A and larger than the internal cavity width dimension of the second rail 210 of FIG. 5B. A third carrier 224 has a carrier shaft 226 with rollers 228 attached to the carrier shaft 226. The third carrier 224 has a working load rating value associated with it (for example "Extra Large"), and a shaft length. The length of carrier shaft 226 of the third carrier 224 is sized so that it fits within the internal cavity width dimension 222 of the third rail 220. However, in accordance with one embodiment of the present disclosure, the length of carrier shaft 226 of the third carrier 224 is sized so that it will not physically fit within the internal cavity 203 of the first rail 202 or within the internal cavity 212 of the second rail 210. By virtue of the size of the third carrier shaft 226 being larger than the internal cavities 203, 212 of the first rail 202 and the second rail 210, an operator of the lift system 100 would not inadvertently attach the third carrier 224 having a larger working load rating value (such as "Extra Large", i.e., 250 kg maximum) to a rail having a lower working load rating value (such as "Large", i.e., 150 kg max or "Medium", i.e., 100 kg maximum). This thereby promotes proper component compatibility of the lift system during use by an operator.

Figure 5D:
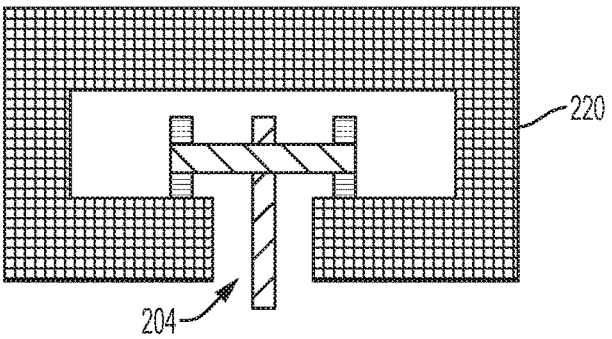
FIG. 5D illustrates another embodiment of a rail and a carriage positioned within the rail, according to one or more embodiments described herein.

Another benefit of an embodiment of the present disclosure is that it is possible to connect or attach a lift with a lower working load rating, to a rail having a larger working load rating. Referring to FIG. 5D, a carrier body 204 having a working load rating value (such as the first carrier body 204 having a "Medium" rating) can be connected with a rail 220 having a larger working load rating value (such as the third rail 220 having a rating of "Extra Large"). This compatibility is acceptable since the carrier working load rating value is less than the working load rating value of the rail 220, which in use would not exceed the working load rating of the rail.

Figure 6D:
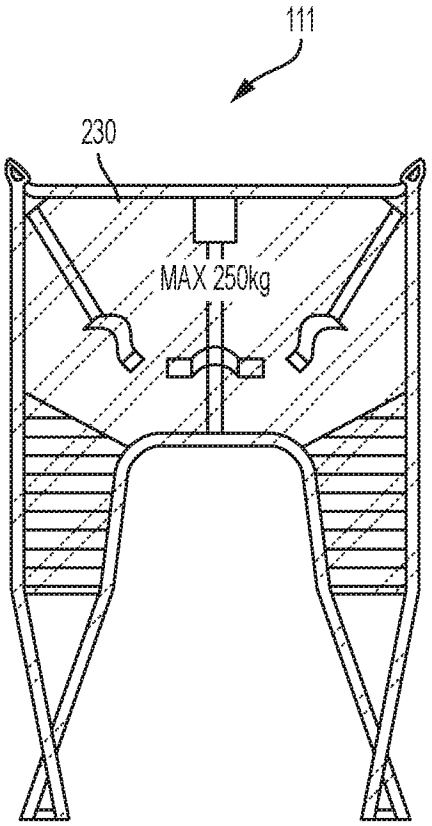
FIG. 6D illustrates another embodiment of a lifting accessory (in the form of a sling in this example), according to one or more embodiments described herein.
Figure 6C:
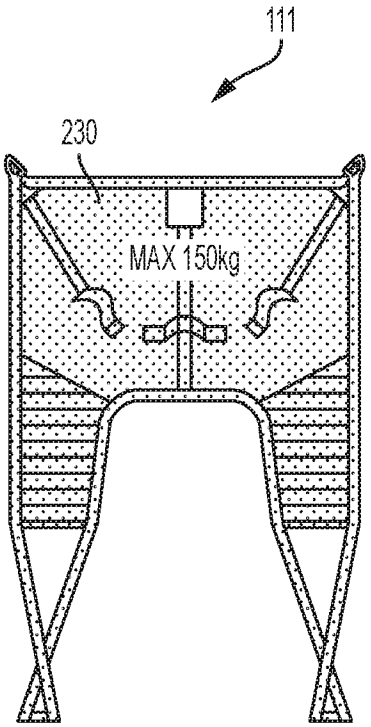
FIG. 6C illustrates another embodiment of a lifting accessory (in the form of a sling in this example), according to one or more embodiments described herein.
Figure 6B:
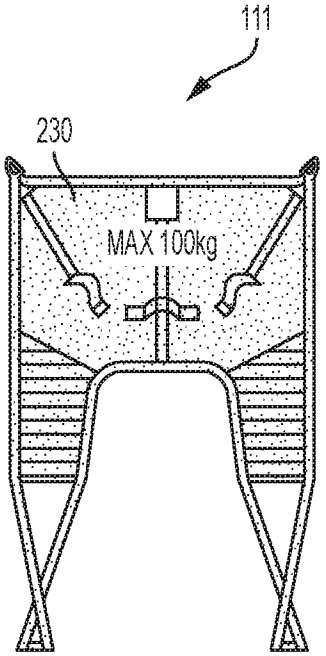
FIG. 6B illustrates another embodiment of a lifting accessory (in the form of a sling in this example), according to one or more embodiments described herein.
Figure 6A:
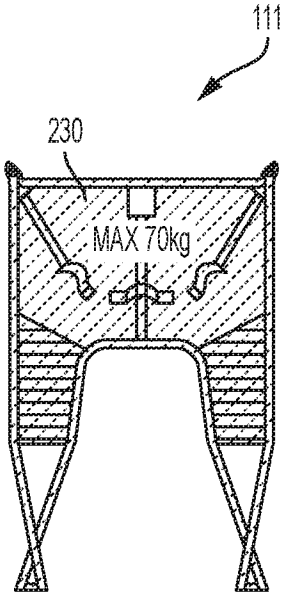
FIG. 6A illustrates one embodiment of a lifting accessory (in the form of a sling in this example), according to one or more embodiments described herein.

In accordance with another example of the present disclosure, lift accessories 111 (such as but not limited to lifting slings, lifting vests, lifting straps, lifting sheets, or the like) may be provided with identifiers or indicators 230 as to their working load capacities, and lift accessories 111 may include similar indicators including, for example, a color, an alpha-numeric indicator, a symbol or combinations thereof, which indicate the working load capacities of the corresponding lift accessories. In one example and as shown in FIG. 6A, a first lift accessory 111 having a working load rating of "Small" is labeled with a weight indicator 230, such as but not limited to and by way of example, "Max 70 kg" and the first lift accessory 111 may be formed using a material of a first color. In another example, a second lift accessory 111 of FIG. 6B having a working load rating of "Medium" is labeled with a weight indicator 230, such as but not limited to and by way of example, "Max 100 kg" and the second lift accessory 111 of FIG. 6B may be formed using a material of a second color that is different from the first color of FIG. 6A. In another example, a third lift accessory 111 of FIG. 6C having a working load rating of "Large" is labeled with a weight indicator 230, such as but not limited to and by way of example, "Max 150 kg" and the third lift accessory 111 may be formed using a material of a third color that is different from the first and second colors. In another example, a fourth lift accessory 111 of FIG. 6D having a working load rating of "Extra Large" is labeled with a weight indicator 230, such but not limited to and by way of example, "Max 250 kg" and the fourth lift accessory 111 may be formed using a material of a fourth color that is different from the first, second and third colors. While specific reference has been made herein to colors, it should be understood that other indicators are contemplated and possible including, for example, symbols attached to or integrated with the lift accessories, the symbols being generally indicative of the working load capacity of the lift accessory. It is understood that in practice, the particular weight load maximum values for each working load rating can vary depending upon the particular implementation or upon particular industry standards or practices. The identifiers or indicators 230 can take various forms, such as tags or labels that are attached to or integrated with the slings, or may be printed onto the slings.

In accordance with another example of the present disclosure, a ceiling lift unit/carrier 104 (or mobile lift unit/carrier) and lift accessory 111 are sized so that only compatible components with comparable working load ratings can be connected together during use. Specifically, in one example of the present disclosure, the thickness or cross-sectional diameters of the attachment handles 122, 124 of the lift accessories 111 are uniquely sized, and the openings 240 of the sling bar 110 of the ceiling lift units/carriers 104 (or of a mobile lift) are also uniquely sized, such that only certain lift accessories 111 can be connected with appropriate sling bars of ceiling lifts or, in the alternative, with sling bars of mobile lifts, in a manner that compatible working load ratings are maintained. The thickness or cross-sectional dimensions of attachment handles 122, 124 can be formed in various manners, such as by way of example only, by using webbing of different sizes or by using webbing wrapped around an internal filler (such as fiber core) of different diameters.

Figure 7A:
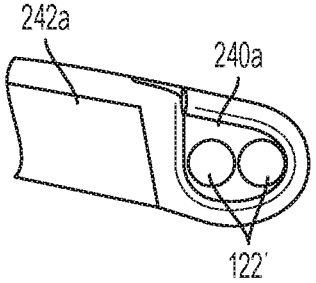
FIG. 7A illustrates embodiment of sling bar with portions of a lifting accessory coupled therewith, according to one or more embodiments described herein.
Figure 7B:
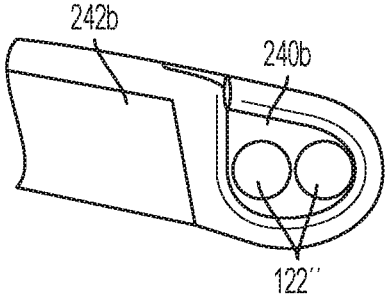
FIG. 7B illustrates another embodiment of sling bar with portions of a lifting accessory coupled therewith, according to one or more embodiments described herein.
Figure 7C:
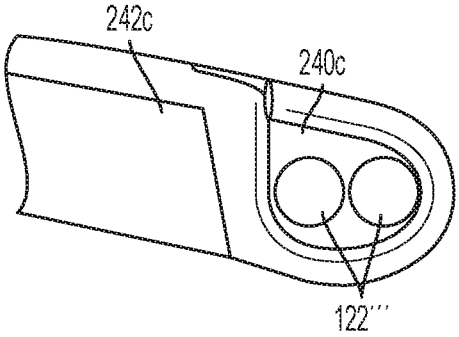
FIG. 7C illustrates another embodiment of sling bar with portions of a lifting accessory coupled therewith, according to one or more embodiments described herein.

While the example embodiments of FIGS. 7A-7C are described in use with a sling bar of a ceiling lift unit/carrier 104, it is understood that the embodiments of FIGS. 7A-7C could be used with mobile lift units as well. Mobile lift units are stand-alone structures that are configured to roll up next to a bed or chair, attach to a patient, and lift the patient. The sling bar can be attached to a lift arm of the mobile lift unit, which is then raised and lowered. Various mobile lift units can be used in conjunction with these embodiments, such as but not limited to mobile lift units including a Viking-M mobile lift manufactured by Liko of Lulea, Sweden.

Referring to FIG. 7A, a first sling bar 242*a* of a ceiling lift (or of a mobile lift) has a pair of openings 240*a* (the openings may each include a spring loaded, normally closed clasp), one opening on each end of the sling bar (only one opening 240*a* of the pair is shown). The openings 240*a* of the first sling bar 242*a* are adapted to receive a pair of attachment handles (shown as 122') of a first sling. The thickness or cross-sectional diameter of the attachment handles 122' of the sling are uniquely sized so that the attachment handles fit within the openings 240*a*. As shown in FIG. 7A, in one example, each opening 240*a* of the first sling bar is sized to receive two attachment handles 122' within the opening 240*a* of the sling bar 242*a*. The size of each opening 240*a* of the sling bar 242*a*, as well as the diameter of the attachment handles 122', are selected to closely match, such that the working load rating of the lift accessory 111 does not exceed the working load rating of the ceiling lift unit/carrier 104 (or mobile lift/carrier) and/or the working load rating of the sling bar 242*a*. In other words, the first sling bar 242*a* has a working load rating, and the first lift accessory 111 has a working load rating that is equal to or less than the working load rating of the ceiling lift unit/carrier 104 (or mobile lift). Lift accessories 111 with higher working load ratings (relative to the working load rating of the ceiling lift unit/carrier 104 or mobile lift/carrier) have attachment handle diameters that are larger than can be received within the openings of the first sling bar—which thereby discourages a user from connecting an improper lifting accessory to a sling bar of a ceiling lift or mobile lift, and aids a user in matching and connecting the correct sling with the appropriate ceiling lift or mobile lift in terms of working load ratings.

In FIG. 7B, a partial view of a second sling bar 242*b* for a ceiling lift or a mobile lift has a pair of openings 240*b* (only one opening 240*b* is shown), wherein the openings of the second sling bar are adapted to receive a pair of attachment handles (shown as 122") of a second lifting accessory such as sling. The thickness or cross-sectional diameter of the attachment handles 122" of the second lifting accessory sling are uniquely sized so that the attachment handles fit within the openings 240*b* of the second sling bar 242*b*. Note that the first lifting accessory could be attached to the second sling bar, since the diameters of the attachment handles 122' of the first lifting accessory are smaller than the diameters of the attachment handles 122" of the second lifting accessory. In this manner, the second sling bar could be connected with lifting accessories (i.e., slings) of similar or lower working load ratings.

In FIG. 7C, a partial view of a third sling bar 242*c* of a ceiling lift or a mobile lift has a pair of openings 240*c* (only one opening 240*c* is shown), wherein the openings of the third sling bar are adapted to receive a pair of attachment handles (shown as 122'") of a third lifting accessory (i.e., a sling). The thickness or cross-sectional diameter of the attachment handles 122'" of the third lifting accessory are uniquely sized so that the attachment handles 122'" fit within the openings of the third sling bar. Note that the first lifting accessory or second lifting accessory could be attached to the third sling bar, since the diameters of the attachment handles of the first lift accessory 111 or second lift accessory 111 are smaller than the diameters of the attachment handles 122'" of the third lifting accessory. In this manner, the third sling bar could be connected with lifting accessories of similar or lower working load ratings.

It is understood that various embodiments of a patient lift system could be formed using one or more features or structures described herein. In addition, a patient lift system could be formed using combinations of features or structures described herein, such as a system having rails and carriers that are sized to encourage interconnections between components that have similar working load ratings, while also employing accessories with unique indicators corresponding to the working load capacity of the accessories. For example, the accessories may be color-coded slings that have handles that are sized to mate with uniquely sized sling bars.

While various embodiments of the present disclosure have been described with reference to a rail-mounted patient lift system, it is understood that one or more features or structures disclosed herein could be used with non-rail mounted patient lift systems, such as portable patient lift devices having lift arms or other lifting mechanisms.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A rail-mounted patient lift system, comprising:

a rail having a carriage support channel formed in the rail, the carriage support channel having a width, wherein the rail has a working load rating;

a carriage slidably disposed in the rail for relative movement to the rail, the carriage comprising a shaft having a length; and a lift unit coupled to the carriage, the lift unit operable to raise and lower a lifting strap, wherein the lift unit has a working load rating;

wherein the length of the shaft of the carriage is less than the width of the carriage support channel when the working load rating of the lift unit is equal to or less than the working load rating of the rail, and the length of the shaft of the carriage is greater than the width of the carriage support channel when the working load rating of the lift unit is greater than the working load rating of the rail.

2. The system of claim 1, wherein the length of the shaft of the carriage is greater than the width of the carriage support channel when the working load rating of the lift unit is larger than the working load rating of the rail.

3. The system of claim 1, wherein the carriage support channel of the rail does not receive the shaft of the lift unit when the working load rating of the lift unit is larger than the working load rating of the rail.

4. The system of claim 1, further comprising: a sling bar attached with the lifting strap; and a lifting accessory coupled with the sling bar.

5. The system of claim 4, wherein the lifting accessory includes an identifier indicating the working load rating of the lifting accessory.

6. The system of claim 4, wherein the lifting accessory includes a unique color that corresponds with a working load rating of the lifting accessory.

7. The system of claim 4, wherein the sling bar includes an opening that is sized to receive one or more attachment handles of the lifting accessory if the working load rating of the lift unit is larger than the working load rating of the lifting accessory.

8. A patient lift system comprising:

a first rail having a first carriage support channel formed in the first rail, the first carriage support channel having a first width, wherein the first rail has a first working load rating;

a second rail having a second carriage support channel formed in the second rail, the second carriage support channel having a second width, wherein the second rail has a second working load rating that is less than the first working load rating; and a first lift unit comprising a first carrier body comprising a first carrier shaft having a shaft length, wherein the first lift unit has a first lift working load rating that is equal to or less than the first working load rating of the first rail and greater than the second working load rating of the second rail;

wherein the shaft length of the first carrier shaft of the first carrier body is less than the width of the first carriage support channel when the working load rating of the first lift unit is equal to or less than the first working load rating of the first rail, and the shaft length of the first carrier shaft of the first carrier body is greater than the width of the second carriage support channel when the working load rating of the first lift unit is greater than the second working load rating of the second rail.

9. The patient lift system of claim 8 further comprising:

a second lift unit comprising a second carrier body comprising a second carrier shaft having a shaft length, wherein:

the second lift unit has a second lift working load rating that is less than the first lift working load rating of the first lift unit, equal to or less than the first working load rating of the first rail and equal to or less than the second working load rating of the second rail; and the shaft length of the second carrier shaft of the second carrier body is less than the width of the first carriage support channel and less than the width of the second carriage support channel.

* * * * *